US007921829B2

(12) United States Patent
Hayashi

(10) Patent No.: US 7,921,829 B2
(45) Date of Patent: Apr. 12, 2011

(54) ENGINE COOLING MEDIUM CIRCULATION DEVICE

(75) Inventor: Kunihiko Hayashi, Ashigarakami-gun (JP)

(73) Assignee: Toyota Jidosha Kabushiki Kaisha, Aichi (JP)

( * ) Notice: Subject to any disclaimer, the term of this patent is extended or adjusted under 35 U.S.C. 154(b) by 244 days.

(21) Appl. No.: 12/063,840

(22) PCT Filed: Nov. 9, 2006

(86) PCT No.: PCT/JP2006/322796

§ 371 (c)(1),
(2), (4) Date: Feb. 14, 2008

(87) PCT Pub. No.: WO2007/058225

PCT Pub. Date: May 24, 2007

(65) Prior Publication Data

US 2009/0114171 A1 May 7, 2009

(30) Foreign Application Priority Data

Nov. 17, 2005 (JP) ..... 2005-332399

(51) Int. Cl.
*F02M 25/07* (2006.01)
*F02B 47/08* (2006.01)

(52) U.S. Cl. ..... 123/568.12; 123/41.31

(58) Field of Classification Search ..... 123/41.28, 123/41.29, 31, 41.33, 568.12, 563, 41.31; 60/599, 605.2

See application file for complete search history.

(56) References Cited

U.S. PATENT DOCUMENTS

| | | | | |
|---|---|---|---|---|
| 5,732,688 | A * | 3/1998 | Charlton et al. | 123/568.12 |
| 6,138,649 | A * | 10/2000 | Khair et al. | 123/568.12 |
| 6,848,434 | B2 * | 2/2005 | Li et al. | 123/568.12 |
| 7,089,890 | B2 * | 8/2006 | Obidi | 123/41.31 |
| 7,237,513 | B2 * | 7/2007 | Pfeffinger et al. | 123/41.29 |
| 2003/0079265 | A1 | 5/2003 | Saito et al. | |

FOREIGN PATENT DOCUMENTS

| | | | |
|---|---|---|---|
| EP | 1 405 991 | A1 | 4/2004 |
| JP | 57-176316 | A | 10/1982 |
| JP | 62-298616 | A | 12/1987 |
| JP | 03-225015 | A | 10/1991 |
| JP | 10-110654 | A | 4/1998 |
| JP | 2001-140701 | A | 5/2001 |
| JP | 2002-147292 | A | 5/2002 |
| JP | 2002-227646 | A | 8/2002 |

* cited by examiner

*Primary Examiner* — Willis R Wolfe, Jr.
(74) *Attorney, Agent, or Firm* — Sughrue Mion, PLLC

(57) ABSTRACT

A cooling water circulation system (100) is configured so that cooling water is delivered from a water pump (113) toward a cylinder head (111) via a pump delivery pipe (114). Further, the system (100) is configured so that an engine block cooling switching section (170) changes the supply of the cooling water from the cylinder head (111) to a cylinder block (112) in accordance with a cooling water temperature. An EGR cooler branch pipe (151), which branches off from the pump delivery pipe (114), is connected to an EGR cooler (150). The EGR cooler branch pipe (151) is provided with an EGR cooler cooling switching valve (153) that opens or closes in accordance with an operating state.

6 Claims, 5 Drawing Sheets

ENGINE COOLING MEDIUM CIRCULATION DEVICE

BACKGROUND OF THE INVENTION

1. Technical Field

The present invention relates to a device that is configured to circulate a cooling medium for an engine (hereinafter simply referred to as the "circulation device").

2. Background Art

Conventional circulation devices having various configurations are known. For example, the configurations disclosed by Japanese Patents JP-A No. 140701/2001, JP-A No. 147292/2002, and JP-A No. 227646/2002 cool an EGR gas by circulating cooling water, which is introduced from a circulation path for engine cooling water, into an EGR cooler and exchanging heat between the cooling water and EGR gas. Here, an EGR (exhaust gas recirculation) technology is used to purify an exhaust gas of a diesel engine or the like. That is, in the EGR technology, part of the exhaust gas is recirculated to intake air to reduce the amount of NOx in the exhaust gas. This reduces the combustion temperature and inhibits the generation of NOx.

SUMMARY OF THE INVENTION

In the circulation devices, various processing targets by the cooling medium or coolant for the engine are placed in a circulation path for the cooling medium in addition to the EGR cooler. When the cooling medium circulates within the circulation path, heat exchange occurs between the processing targets and the cooling medium.

Heat generated, for instance, at the processing targets is then absorbed by means of heat exchange with the cooling medium. Consequently, the processing targets such as a cylinder head, a cylinder block, and an EGR cooler are cooled. Or the processing targets such as a radiator and a heater absorb heat from the cooling medium, thereby raising the temperatures of the processing targets and lowering the temperature of the cooling medium.

Meanwhile, among the various processing targets such as the cylinder head, the cylinder block, and the EGR cooler, the appropriate temperature for proper operation may vary from one to another.

As regards, for instance, the cylinder block, it may be advantageous to cut off the introduction of the cooling medium into the cylinder block immediately after a cold start (particularly in cold climates) because friction loss should be reduced by raising the lubricating oil temperature to a certain extent. As regards the cylinder head, however, the cooling medium should better be introduced to positively cool the cylinder head immediately after a start because an air-fuel mixture burns in a combustion chamber to generate heat. As regards the EGR cooler, it is desired that the generation of NOx be inhibited by cooling the EGR gas; however, excessive EGR gas cooling will lead to the generation of HC and the like. To keep the EGR cooler at an appropriate temperature under these circumstances, it is necessary to properly control the introduction of the cooling medium into the EGR cooler in accordance with the operating state.

The present invention provides the circulation device that is capable of properly controlling the supply of the cooling medium for the engine to the processing targets to ensure that the processing targets may properly operate.

(1) The circulation device according to the present invention is a so-called dual cooling device that is capable of independently controlling the cooling state of the cylinder head and the cylinder block. More specifically, the circulation device according to the present invention comprises a head internal cooling medium path, a block internal cooling medium path, a block cooling limitation section, an EGR cooler, and an EGR cooling control section.

The head internal cooling medium path is formed inside the cylinder head. The block internal cooling medium path is formed inside the cylinder block. The block cooling limitation section is configured to be capable of limiting the passage of the cooling medium in the block internal cooling medium path in accordance with the temperature of the cooling medium.

The EGR cooler is placed in an EGR path that is configured to introduce a gas from an exhaust path of the engine to an intake path. The EGR cooler is configured to be capable of cooling the gas by exchanging heat between the gas and the cooling medium. The EGR cooling control section is configured to control the supply of the cooling medium to the EGR cooler.

In this configuration, the cylinder head is cooled when the cooling medium passes through the head internal cooling medium path. Further, the cylinder block is cooled when the cooling medium passes through the block internal cooling medium path. In accordance with the temperature of the cooling medium, the block cooling limitation section limits the passage of the cooling medium in the block internal cooling medium path. More specifically, when, for instance, the temperature of the cooling medium is low (at the time of a cold start), the passage of the cooling medium in the block internal cooling medium path is limited. It means that cylinder block cooling by the cooling medium is limited when the temperature of the cooling medium is low.

Moreover, the EGR cooling control section controls the supply of the cooling medium to the EGR cooler.

It is preferred that the circulation device according to the present invention constantly allow the cooling medium to pass through the head internal cooling medium path while the engine operates.

When the above configuration is employed, the block cooling limitation section and EGR cooling control section can properly control the cooling states of the cylinder block and EGR cooler in accordance with the operating state. Therefore, the use of the above configuration makes it possible to properly control the supply of the cooling medium for the processing targets so that the processing targets such as the cylinder head, the cylinder block, and the EGR cooler to be cooled by the cooling medium may properly operate.

(2) The circulation device may further comprise a cooling medium delivery section, a cooling medium delivery pipe, an EGR cooling branch pipe, and an EGR cooling medium discharge pipe. The EGR cooling control section may include an EGR cooling adjustment valve that is installed in the EGR cooling branch pipe or the EGR cooling medium discharge pipe. The cooling medium delivery section is configured to be capable of delivering the cooling medium to the cylinder head or head internal cooling medium path. The cooling medium delivery pipe is arranged to connect the cooling medium delivery section to the cylinder head or head internal cooling medium path. The EGR cooling branch pipe branches off from the cooling medium delivery pipe and is connected to the EGR cooler. The EGR cooling medium discharge pipe comprises a path for discharging the cooling medium from the EGR cooler and is connected to the EGR cooler.

In other words, in the configuration described above, the EGR cooling branch pipe for supplying the cooling medium to the EGR cooler branches off from a portion of the cooling medium delivery pipe that is positioned forward of the cylinder head or head internal cooling medium path.

When the above configuration is employed, the EGR cooling adjustment valve installed in the EGR cooling branch pipe or EGR cooling medium discharge pipe controls the supply of the cooling medium to the EGR cooler.

More specifically, when the EGR cooling adjustment valve is open, the cooling medium delivered from the cooling medium delivery section toward the cylinder head may partly flow into the EGR cooling branch pipe, which branches off from the cooling medium delivery pipe. The cooling medium that has flowed into the EGR cooling branch pipe is supplied to the EGR cooler and then discharged toward the EGR cooling medium discharge pipe from the EGR cooler. The EGR cooler is cooled because the cooling medium flows within an EGR cooling system, which comprises the EGR cooling branch pipe, EGR cooler, and EGR cooling medium discharge pipe.

When, on the other hand, the EGR cooling adjustment valve is closed, the EGR cooling adjustment valve limits the flow of the cooling medium within the EGR cooling system. In this instance, the cooling of the EGR cooler is restricted.

When the above configuration is employed, the cooling medium at a relatively low temperature, which prevails before absorbing the heat generated by the cylinder head, is supplied to the EGR cooler via the EGR cooling branch pipe. Therefore, the configuration described above effectively cools the EGR cooler. Further, the use of the above configuration makes it possible to control the cooling state of the EGR cooler with ease in accordance with the operating state of the engine by controlling the open/closed state of the EGR cooling adjustment valve.

(3) The circulation device according to the present invention may further comprise a radiator that is positioned upstream of the cooling medium delivery section in the flow direction of the cooling medium. The EGR cooling branch pipe may be configured so that the cooling medium passed through the radiator and delivered by the cooling medium delivery section may flow into the EGR cooling branch pipe.

In the configuration described above, the cooling medium, which is cooled as the radiator exchanges heat with outside air, is supplied from the radiator to the cooling medium delivery section. The cooling medium is then delivered from the cooling medium delivery section toward the cylinder head. In this instance, part of the cooling medium flows into the EGR cooling branch pipe, which branches off from the cooling medium delivery pipe.

When the above configuration is employed, the cooling medium at a relatively low temperature, which prevails after being cooled by the radiator but before absorbing the heat generated by the cylinder head, is supplied to the EGR cooler via the EGR cooling branch pipe. Therefore, the configuration described above cools the EGR cooler with increased effectiveness.

(4) The circulation device according to the present invention may further comprise a cylinder head discharge pipe, a cylinder block discharge pipe, and an inter-block flow path. The valve mechanism may comprise a first adjustment valve that is configured to change the flow state of the cooling medium between the cylinder head discharge pipe, cylinder block discharge pipe, and radiator in accordance with the temperature of the cooling medium. Here, the cylinder head discharge pipe comprises a path for the cooling medium to flow from the cylinder head to the radiator and is connected to the head internal cooling medium path. The cylinder block discharge pipe comprises a path for the cooling medium to flow from the cylinder block to the radiator and is connected to the block internal cooling medium path. The inter-block flow path connects the head internal cooling medium path to the block internal cooling medium path.

The inter-block flow path is positioned near a joint between the cylinder block and cylinder head. The inter-block flow path may be formed inside an engine block, which is a joint body between the cylinder block and cylinder head, or formed outside the joint body.

In the configuration described above, the first adjustment valve changes the flow state of the cooling medium, which flows from the head internal cooling medium path to the radiator via the cylinder head discharge pipe, in accordance with the temperature of the cooling medium.

In other words, the flow path of the cooling medium, which flows from the head internal cooling medium path to the block internal cooling medium path via the inter-block flow path, absorbs the heat generated by the cylinder block, and flows to the radiator via the cylinder block discharge pipe, is formed in accordance with the temperature of the cooling medium.

When the above configuration is employed, the cooling state of the cooling medium cooled by the radiator is changed in accordance with the temperature of the cooling medium or the operating state of the engine. Therefore, when the above configuration is employed, the cooling states of the cylinder head, cylinder block, and EGR cooler can be properly controlled through the use of a simple device configuration.

(5) The circulation device according to the present invention may further comprise a radiator discharge pipe, a bypass pipe, and a second adjustment valve. The radiator discharge pipe connects the radiator to the cooling medium delivery section. The bypass pipe connects the cylinder head discharge pipe to the radiator discharge pipe. The second adjustment valve is configured to change the flow state of the cooling medium in the bypass pipe in accordance with the temperature of the cooling medium.

In the configuration described above, the second adjustment valve changes the flow state of the cooling medium that passes through the bypass pipe (bypasses the radiator and flows from the cylinder head discharge pipe to the radiator discharge pipe). In other words, the second adjustment valve determines whether the cooling medium, which is discharged from the head internal cooling medium path via the cylinder head discharge pipe, passes through the radiator and gets cold by heat exchange with outside air.

When the above configuration is employed, the cooling state of the cooling medium cooled by the radiator is changed in accordance with the temperature of the cooling medium or the operating state of the engine. Therefore, when the above configuration is employed, the cooling states of the cylinder head, cylinder block, and EGR cooler can be properly controlled through the use of a simple device configuration.

(6) The EGR cooling control section may be configured to place a limit on the supply of the cooling medium to the EGR cooler during a warm-up period of the engine and lift the limit on the supply of the cooling medium to the EGR cooler at around the end of the warm-up period.

In the configuration described above, the EGR cooling control section places a limit on the supply of the cooling medium to the EGR cooler during a warm-up period of the engine. After the warm-up period, the limit on the supply of the cooling medium to the EGR cooler is to be lifted.

The use of the above configuration makes it possible to avoid excessive cooling of EGR gas during a warm-up period. Further, the use of the above configuration makes it possible to effectively cool the EGR gas and effectively inhibit, for instance, the generation of NOx, after the warm-up period.

(7) The circulation device according to the present invention may further comprise a high-temperature coolant supply section that is configured to supply warmed cooling medium to the EGR cooler at the time of a cold start.

It is assumed that the "warmed" cooling medium is the cooling medium whose temperature is higher than the cooling medium temperature for a normal cold start that is substantially equal to the outside air temperature. For example, the "warmed" cooling medium may correspond to the cooling medium that is thermally insulated and stored after being warmed to a sufficiently high temperature during the last engine operation (subsequent to a warm-up period) or to the cooling medium that is warmed by a heater, latent heat storage unit, or other predetermined heating means.

In the configuration described above, the high-temperature coolant supply section supplies the warmed cooling medium to the EGR cooler at the time of a cold start. The term "at the time of a cold start" may include "immediately before a cold start," "simultaneously with a cold start," and "immediately after a cold start."

When the above configuration is employed, the temperature of the cooling medium supplied to the EGR cooler is raised at the time of an ultracold start to avoid excessive EGR gas cooling. This enables a simple device configuration to effectively avoid emission degradation that may occur when a low-temperature EGR gas is introduced into a combustion chamber.

DETAILED DESCRIPTION OF THE PREFERRED EMBODIMENT

An embodiment of the present invention (an embodiment that is considered to be the best by the applicant at the time of application of the present invention) will now be described with reference to the accompanying drawings.

<Cooling Water Circulation System Configuration Overview>

Figure 1:
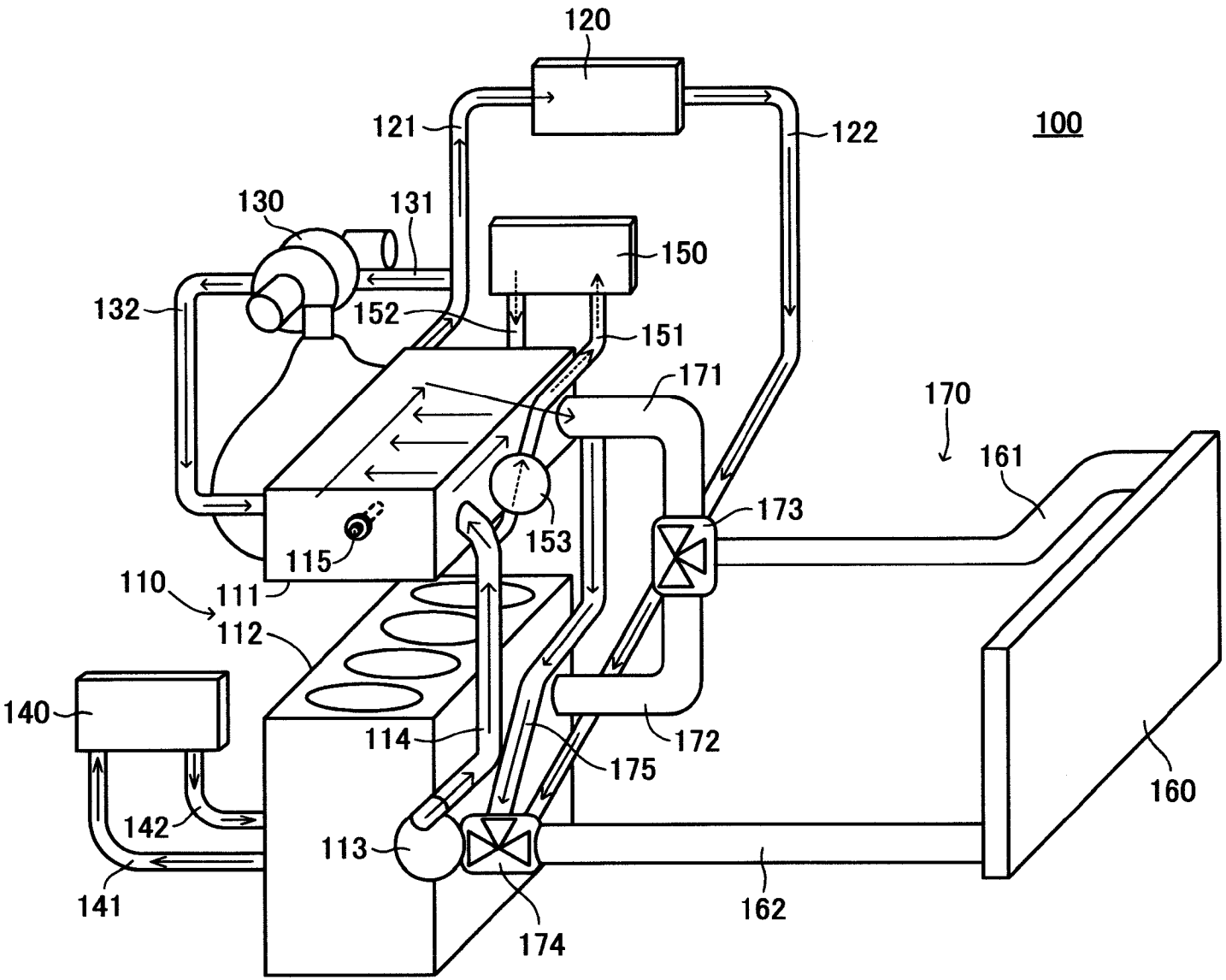
FIG. 1 is a schematic diagram illustrating a cooling water circulation system according to an embodiment of the present invention.

FIG. 1 is a schematic diagram illustrating a cooling water circulation system 100 according to an embodiment of the present invention.

The cooling water circulation system 100 includes an engine block 110, a heater 120, a turbocharger 130, an oil cooler 140, an EGR cooler 150, a radiator 160, and an engine block cooling switching section 170.

The engine block 110 includes a cylinder head 111 and a cylinder block 112. The lower lateral side of the cylinder block 112 is provided with a water pump 113, which causes cooling water to circulate in the cooling water circulation system 100. A cooling water outlet of the water pump 113 is connected to one end of a pump delivery pipe 114. The other end of the pump delivery pipe 114 is connected to the cylinder head 111. In other words, the water pump 113 is configured to deliver the cooling water toward the cylinder head 111.

A water temperature sensor 115 is mounted on the cylinder head 111. The water temperature sensor 115 is configured to generate an output signal that represents the temperature of the cooling water in the cylinder head 111.

<Engine Block Configuration>

Figure 2:
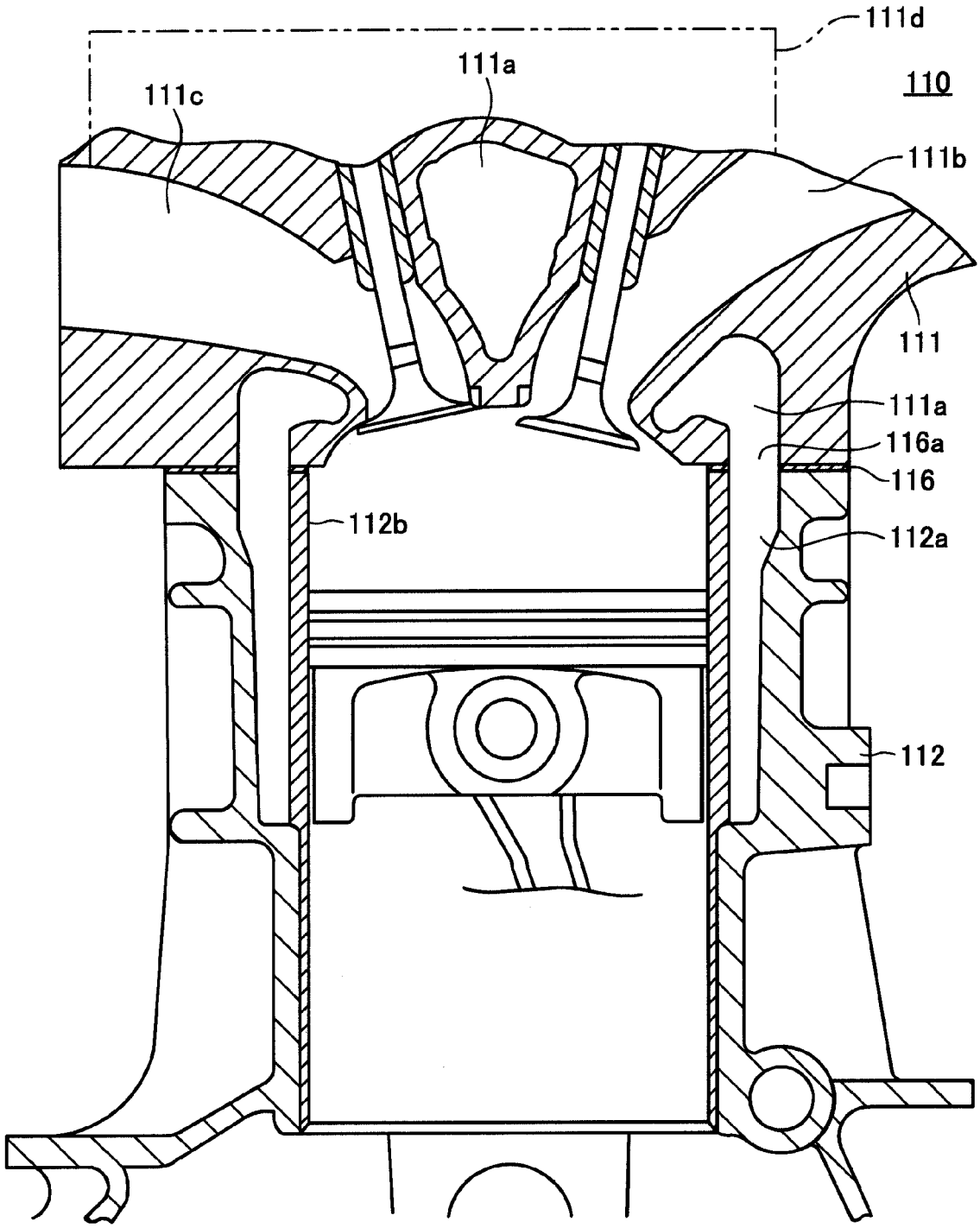
FIG. 2 is cross-sectional view illustrating an engine block that is shown in FIG. 1.

FIG. 2 is a cross-sectional view illustrating the engine block 110, which is shown in FIG. 1.

A cylinder head internal water jacket 111*a*, which is a cooling water flow path, is formed inside the cylinder head 111. Further, an intake path 111*b* and an exhaust path 111*c* are formed in the cylinder head 111. The intake path 111*b* and exhaust path 111*c* are interconnected by an EGR path 111*d*. The EGR path 111*d* is configured so that part of an exhaust gas passing through the exhaust path 111*c* can be introduced into the intake path 111*b*.

A cylinder block internal water jacket 112*a* is formed inside the cylinder block 112. The cylinder block internal water jacket 112*a* is a cooling water flow path that is formed in the cylinder block 112. It is formed so as to enclose a cylinder bore 112*b*.

The cylinder head 111 and cylinder block 112 are joined together via a gasket 116. A through-hole 116*a* is formed in the gasket 116. The through-hole 116*a* is formed to connect the cylinder head internal water jacket 111*a* to the cylinder block internal water jacket 112*a*. In other words, the through-hole 116*a* made in the joint between the cylinder head 111 and cylinder block 112 is formed so that the cooling water can flow from the cylinder head internal water jacket 111*a* to the cylinder block internal water jacket 112*a*.

<Connection Between Engine Block and Peripheral Devices>

Referring again to FIG. 1, the cylinder head 111 and heater 120 are interconnected via a heater supply pipe 121. The heater 120 is connected to a cooling water inlet of the water pump 113 via a heater discharge pipe 122. In other words, the heater supply pipe 121 is configured so that the cooling water can be supplied from the cylinder head 111 to the heater 120. The heater discharge pipe 122 is configured so that the cooling water discharged from the heater 120 can flow back to the water pump 113. A heater system cooling water circulation path, which includes the water pump 113, pump delivery pipe 114, cylinder head 111, heater supply pipe 121, heater 120, and heater discharge pipe 122, is configured so that the cooling water constantly flows during an engine operation.

The turbocharger 130 and the cylinder head 111 are interconnected via a turbo supply pipe 131 and a turbo discharge pipe 132. The turbo supply pipe 131 branches off from the heater supply pipe 121. More specifically, the turbo supply pipe 131 is configured so that the cooling water can be supplied from the cylinder head 111 to the turbocharger 130. The turbo discharge pipe 132 is configured so that the cooling water passing through the turbocharger 130 can flow back to the cylinder head 111. A turbo system cooling water circulation path, which includes the cylinder head 111, turbo supply pipe 131, turbocharger 130, and turbo discharge pipe 132, is configured so that the cooling water constantly flows during an engine operation.

The oil cooler 140 and cylinder block 112 are interconnected via an oil cooler supply pipe 141 and an oil cooler discharge pipe 142. The oil cooler supply pipe 141 is configured so that the cooling water can be supplied from the cylinder block 112 to the oil cooler 140. The oil cooler discharge pipe 142 is configured so that the cooling water passing through the oil cooler 140 can flow back to the cylinder block 112. An oil cooler system cooling water circulation path, which includes the cylinder block 112, oil cooler supply pipe 141, oil cooler 140, and oil cooler discharge pipe 142, is configured so that the cooling water constantly flows while the cooling water flows to the cylinder block 112.

<<Connection Between EGR Cooler and Engine Block>>

The EGR cooler 150 is configured to cool the EGR gas that passes through the EGR path 111*d* (see FIG. 2).

The EGR cooler 150 is connected to an EGR cooler branch pipe 151 that branches off from the pump delivery pipe 114. In other words, the EGR cooler branch pipe 151 is configured so that the cooling water delivered from the water pump 113 is supplied to the EGR cooler 150 via the EGR cooler branch pipe 151. The EGR cooler 150 and cylinder head 111 are interconnected via the EGR cooler discharge pipe 152. The EGR cooler discharge pipe 152 forms a discharge path for the cooling water supplied from the EGR cooler 150, and is configured so that the cooling water passing through the EGR cooler 150 flows into the cylinder head 111.

The EGR cooler branch pipe 151 is provided with an EGR cooler cooling switching valve 153, which is a solenoid valve. The EGR cooler cooling switching valve 153 opens or closes in accordance with an engine operating state such as the cooling water temperature in the cylinder head 111 (the output of the water temperature sensor 115), thereby turning on or turning off the cooling water supply to the EGR cooler 150.

The cooling water circulation system 100 is configured so that the EGR cooler cooling switching valve 153 remains closed during a warm-up period and opens at the end of the warm-up period. However, if, for instance, the engine load is high during a warm-up period, the cooling water circulation system 100 opens the EGR cooler cooling switching valve 153 as needed.

<<Connection Between Radiator and Engine Block>>

The radiator 160 is connected to a radiator supply pipe 161 and a radiator discharge pipe 162.

The radiator supply pipe 161 is configured so that the cooling water discharged from the cylinder head 111 and cylinder block 112 can be supplied (introduced) into the radiator 160.

The radiator discharge pipe 162 connects the radiator 160 to the water pump 113. The radiator discharge pipe 162 is configured so that the cooling water cooled by the radiator 160, which exchanges heat with outside air, can be delivered (discharged) toward the water pump 113.

In other words, the radiator 160 is positioned upstream of the water pump 113 in the flow direction of the cooling water in the cooling water circulation system 100. The cooling water cooled by the radiator 160 can be poured forth from the water pump 113, flowed into the pump delivery pipe 114 and EGR cooler branch pipe 151, and supplied to the cylinder head 111 and EGR cooler 150.

<<<Engine Block Cooling Switching Section Configuration>>>

The engine block cooling switching section 170 is positioned between the engine block 110 and radiator 160. The engine block cooling switching section 170 includes a cylinder head discharge pipe 171, a cylinder block discharge pipe 172, a first thermostat 173, a second thermostat 174, and a bypass pipe 175. The engine block cooling switching section 170 is configured so that the cooling water flows to the cylinder head 111 (cylinder head internal water jacket 111*a* in FIG. 2) during an engine operation. Further, the engine block cooling switching section 170 is configured so that the passage of the cooling water in the cylinder block 112 (cylinder block internal water jacket 112*a* in FIG. 2) can be limited in accordance with the cooling water temperature. The configuration of the engine block cooling switching section 170 is described in detail below.

The cylinder head discharge pipe 171 forms a path for the cooling water to flow from the cylinder head 111 to the radiator 160. One end of the cylinder head discharge pipe 171 is connected to the cylinder head 111 (cylinder head internal water jacket 111*a* in FIG. 2). The other end of the cylinder head discharge pipe 171 is connected to the first thermostat 173.

The cylinder block discharge pipe 172 forms a path for the cooling water to flow from the cylinder block 112 to the radiator 160. One end of the cylinder block discharge pipe 172 is connected to the cylinder block 112 (cylinder block internal water jacket 112*a* in FIG. 2). The other end of the cylinder block discharge pipe 172 is connected to the first thermostat 173.

The first thermostat 173 and radiator 160 are interconnected via the aforementioned radiator supply pipe 161. The first thermostat 173 is configured to change the communication between the cylinder head discharge pipe 171, cylinder block discharge pipe 172, and radiator supply pipe 161 in accordance with the cooling water temperature.

More specifically, when the cooling water temperature is lower than a first valve opening temperature, the first thermostat 173 closes the communication between the cylinder head discharge pipe 171, cylinder block discharge pipe 172, and radiator supply pipe 161. When the cooling water temperature is not lower than the first valve opening temperature and is lower than a second valve opening temperature, the first thermostat 173 opens the communication between the cylinder head discharge pipe 171 and radiator supply pipe 161 while interrupting the communication between the cylinder block discharge pipe 172 and radiator supply pipe 161. When the cooling water temperature is not lower than the second valve opening temperature, the first thermostat 173 opens the communication between the cylinder head discharge pipe 171, cylinder block discharge pipe 172, and radiator supply pipe 161.

The second thermostat 174 is positioned between the radiator discharge pipe 162 and water pump 113. The second thermostat 174 and cylinder head discharge pipe 171 are interconnected via the bypass pipe 175. More specifically, the bypass pipe 175 forms a cooling water flow path for bypassing the radiator 160 by connecting the cylinder head discharge pipe 171 to the radiator discharge pipe 162.

The second thermostat 174 is configured to change the cooling water flow in the bypass pipe 175 in accordance with the cooling water temperature. More specifically, when the cooling water temperature is lower than a predetermined bypass temperature, the second thermostat 174 forms a bypass flow path that connects the cylinder head discharge pipe 171 to the water pump 113 via the bypass pipe 175. When, on the other hand, the cooling water temperature is not lower than the bypass temperature, the second thermostat 174 closes the bypass flow path.

The first thermostat 173 and the second thermostat 174 are configured so that the bypass temperature is substantially equal to the first valve opening temperature.

<Operation of Cooling Water Circulation System According to Embodiment>

An operation performed by the cooling water circulation system 100 according to the present embodiment, which is configured as described above, will now be described with reference to FIGS. 1 to 4.

(A) If the cooling water temperature is lower than the bypass temperature during a warm-up period, the first thermostat 173 closes the communication between the cylinder head discharge pipe 171, cylinder block discharge pipe 172, and radiator supply pipe 161. Further, the second thermostat 174 forms the bypass flow path that connects the cylinder head discharge pipe 171 to the water pump 113 via the bypass pipe 175.

The cooling water flow indicated by arrows in FIG. 1 is then formed. In other words, the cooling water is delivered from the water pump 113 toward the pump delivery pipe 114. The cooling water delivered toward the pump delivery pipe 114 flows into the cylinder head 111 (cylinder head internal water jacket 111*a* in FIG. 2).

The cooling water, which has flowed into the cylinder head 111, cools the cylinder head 111 and then becomes discharged through the heater supply pipe 121. Some of the cooling water delivered toward the heater supply pipe 121 is supplied to the turbocharger 130 via the turbo supply pipe 131 and flows back to the cylinder head 111 via the turbo discharge pipe 132. The remaining portion of the cooling water delivered toward the heater supply pipe 121 is supplied to the heater 120 and flows back to the water pump 113 via the heater discharge pipe 122.

Further, the first thermostat 173 blocks the cooling water flow in the cylinder block discharge pipe 172, that is, blocks the flow of the cooling water discharged from the cylinder block 112. Therefore, the cooling water stays within the cylinder block 112 (cylinder block internal water jacket in FIG. 2). This rapidly raises the temperature in the cylinder block 112. In other words, a rapid warm-up operation progresses. Consequently, the friction in the cylinder block 112 is promptly reduced.

At the resulting cooling water temperature, the EGR cooler cooling switching valve 153 is normally closed. In this instance, the cooling water supply to the EGR cooler 150 is shut off. However, if, for instance, the engine load is high, the EGR cooler cooling switching valve 153 opens as needed to flow the cooling water between the EGR cooler 120 and cylinder head 111 (see broken-line arrows in the figure).

(B) If the cooling water temperature is not lower than the bypass temperature and the first valve opening temperature and is lower than the second valve opening temperature, the second thermostat 174 closes the bypass flow path. Further, the first thermostat 173 opens the communication between the cylinder head discharge pipe 171 and radiator supply pipe 161 while ensuring that the communication between the cylinder block discharge pipe 172 and radiator supply pipe 161 remains closed.

Figure 3:
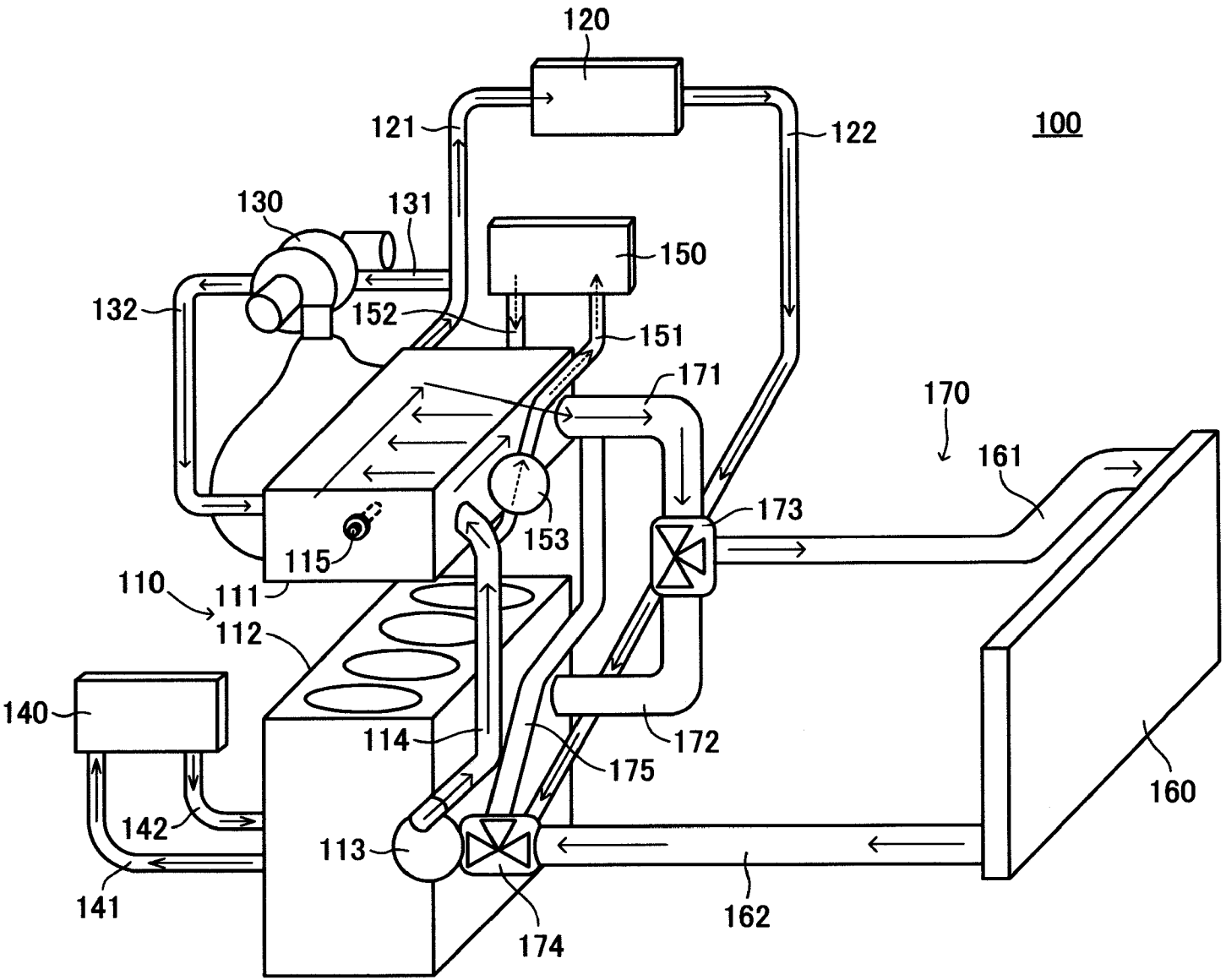
FIG. 3 is Illustration of how the cooling water circulation system shown in FIG. 1 operates.

The cooling water flow indicated by arrows in FIG. 3 is then formed. More specifically, the cooling water flowing from the water pump 113 to the cylinder head 111 via the pump delivery pipe 114 cools the cylinder head 111 and then becomes discharged through the heater supply pipe 121. Some of the cooling water delivered toward the heater supply pipe 121 is supplied to the turbocharger 130 via the turbo supply pipe 131 and flows back to the cylinder head 111 via the turbo discharge pipe 132. The remaining portion of the cooling water delivered toward the heater supply pipe 121 is supplied to the heater 120 and flows back to the water pump 113 via the heater discharge pipe 122.

Next, the cooling water becomes discharged from the cylinder head 111 via the cylinder head discharge pipe 171 and flows to the radiator 160 via the cylinder head discharge pipe 171 and radiator supply pipe 161. The cooling water cooled by the radiator 160 flows back to the water pump 113 via the radiator discharge pipe 162.

Since a warm-up operation is being conducted at the resulting cooling water temperature, the EGR cooler cooling switching valve 153 closes normally, or opens as needed (see broken-line arrows in the figure) as is the case with (A) above.

(C) If the cooling water temperature is not lower than the second valve opening temperature, the first thermostat 173 opens the communication between the cylinder head discharge pipe 171, cylinder block discharge pipe 172, and radiator supply pipe 161.

Figure 4:
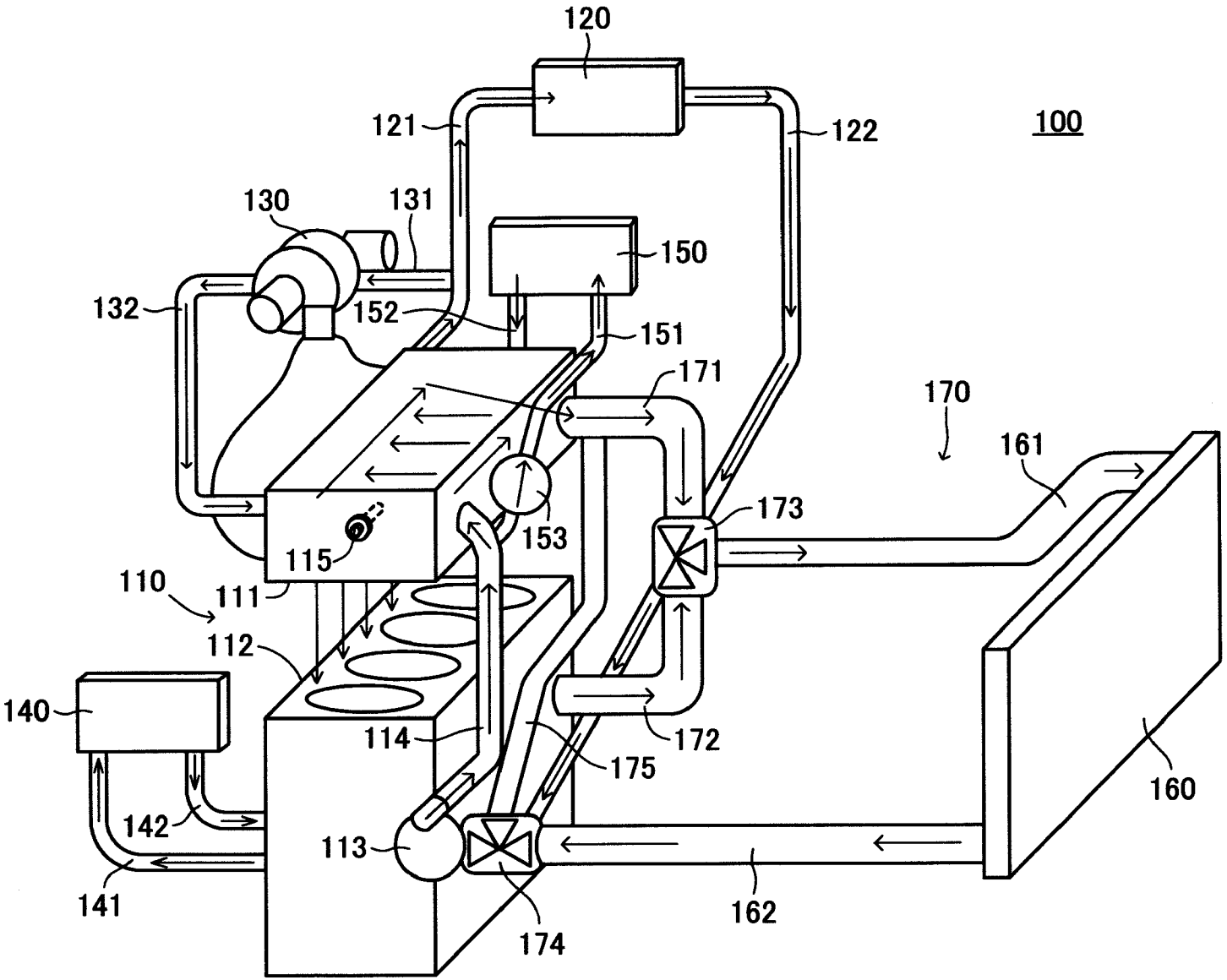
FIG. 4 is Illustration of how the cooling water circulation system shown in FIG. 1 operates.

The cooling water flow indicated by arrows in FIG. 4 is then formed. More specifically, the cooling water flowing from the water pump 113 to the cylinder head 111 via the pump delivery pipe 114 cools the cylinder head 111 and then becomes discharged through the heater supply pipe 121. Some of the cooling water delivered toward the heater supply pipe 121 is supplied to the turbocharger 130 via the turbo supply pipe 131 and flows back to the cylinder head 111 via the turbo discharge pipe 132. The remaining portion of the cooling water delivered toward the heater supply pipe 121 is supplied to the heater 120 and flows back to the water pump 113 via the heater discharge pipe 122.

Further, the cooling water flows from the cylinder head 111 toward the cylinder block 112 via the through-hole 116*a* (see FIG. 2). This cools the cylinder block 112. The cooling water flowing into the cylinder block 112 is supplied to the oil cooler 140 via the oil cooler supply pipe 141, and flows back to the cylinder block 112 via the oil cooler discharge pipe 142.

Subsequently, the cooling water becomes discharged from the cylinder head 111 and cylinder block 112 via the cylinder head discharge pipe 171 and cylinder block discharge pipe 172, and flows into the radiator 160 via the radiator supply pipe 161. The cooling water cooled by the radiator 160 flows back to the water pump 113 via the radiator discharge pipe 162.

At the resulting cooling water temperature, the EGR cooler cooling switching valve 153 opens. In this instance, therefore, the cooling water is supplied to the EGR cooler 120. This cools the EGR cooler 120.

<Effects Provided by Configuration According to Present Embodiment>

Operation and effects provided by the configuration according to the present embodiment will now be described with reference to the accompanying drawings.

The configuration according to the present embodiment makes it possible to individually control the cooling states of the cylinder block 112 and EGR cooler 150 in accordance with an operating state as indicated in FIGS. 1, 3, and 4 while maintaining the cooling performance in the cylinder head 111. In other words, the configuration according to the present embodiment makes it possible to properly control the cooling states of the cylinder head 111, cylinder block 112, and EGR cooler 150 in accordance with an operating state. Therefore, the configuration according to the present embodiment makes it possible to properly control the supply of the cooling water so that the cylinder head 111, cylinder block 112, and EGR cooler 150 operate with increased appropriateness.

When the configuration according to the present embodiment is used, the cooling water at a relatively low temperature, which prevails after being cooled by the radiator 160 but before absorbing the heat generated by the cylinder head 111, is supplied to the EGR cooler 150 via the EGR cooler branch pipe 151. Therefore, the configuration according to the present embodiment effectively cools the EGR cooler 150.

The configuration according to the present embodiment shuts off the cooling water supply to the EGR cooler 150 during an engine warm-up period and supplies the cooling water to the EGR cooler 150 after termination of the engine warm-up period. Therefore, the configuration according to the present embodiment makes it possible to avoid excessive EGR gas cooling during a warm-up period. After termination of the warm-up period, the use of this configuration makes is possible to effectively cool the EGR gas, thereby effectively inhibiting, for instance, the generation of NOx.

Modified Embodiments

As mentioned earlier, the embodiment described above is considered to be the best by the applicant at the time of application of the present invention. The embodiment described above is to be considered in all respects only as illustrative and not restrictive. The present invention is not limited to the foregoing embodiment, but extends to various modifications that nevertheless fall within the scope of the appended claims.

Although some modified embodiments are additionally described below, they are also to be considered only as illustrative and not restrictive. Limited interpretation of the present invention, which is based on the description of the foregoing embodiments and the ensuing description of the modified embodiments, is not to be permitted because it is unduly prejudicial to the interests of the applicant, and unrighteously profitable to imitators.

The modified embodiments described below may be combined as appropriate as far as no technological inconsistency arises.

(i) The configuration according to the present invention can be applied to all types of engines, including gasoline engines and diesel engines.

(ii) The water pump 113 may comprise a mechanical pump that is driven by a rotary drive force generated by a cycling motion of the engine. Alternatively, the water pump 113 may comprise an electric pump.

The water pump 113 may also comprise a variable water pump that can vary the rate of flow to the pump delivery pipe 114. When such a variable water pump is employed, it is possible to improve the coolability of the cylinder head 111 and EGR cooler 150 by raising the rate of flow to the water pump 113 in accordance with the operating state.

(iii) The turbocharger 130 and oil cooler 140 may be omitted. The turbo supply pipe 131 may be directly connected to the cylinder head 111. In place of the turbocharger 130, a different type of supercharger may be used.

(iv) The EGR cooler cooling switching valve 153 may be installed in the EGR cooler discharge pipe 152.

(v) The EGR cooler cooling switching valve 153 may be a thermostat.

(vi) The configuration of the engine block cooling switching section 170 is not limited to the configuration according to the embodiment described above. For example, solenoid valves, mechanical valves, or other valve mechanisms operating according to an external signal may be used instead of the first thermostat 173 and the second thermostat 174.

Figure 5:
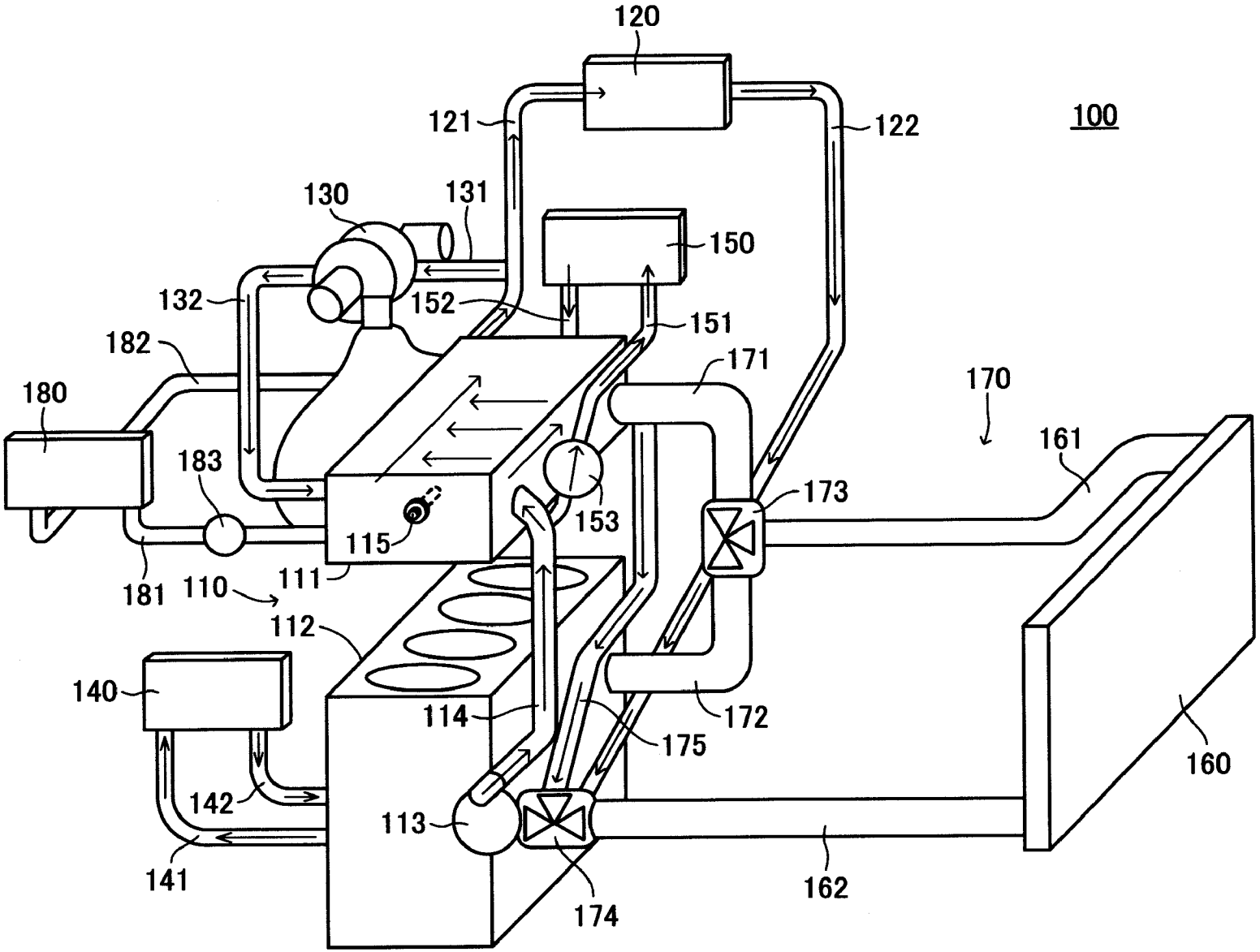
FIG. 5 is a schematic diagram illustrating how a modified version of the cooling water circulation system shown in FIG. 1 is configured.

(vii) A heat storage section 180 may be furnished as indicated in FIG. 5. The heat storage section 180 can keep the cooling water warm and store it for a predetermined period of time because it is configured to store the cooling water in a thermally insulated container.

The heat storage section 180 is connected to one end of a heat storage water introduction pipe 181. The other end of the heat storage water introduction pipe 181 is connected to the cylinder head 111 so that the cooling water (heat storage water) stored in the heat storage section 180 can be introduced into the cylinder head 111.

The heat storage section 180 is also connected to one end of a heat storage section supply pipe 182. The other end of the heat storage section supply pipe 182 is connected to the cylinder head 111 so that the cooling water in the cylinder head 111 can be supplied to the heat storage section 180.

Further, the heat storage water introduction pipe 181 is provided with a heat storage water introduction pump 183. The heat storage water introduction pump 183 is configured to introduce the cooling water stored in the heat storage section 180 to the cylinder head 111 and supply the cooling water in the cylinder head 111 to the heat storage section 180.

In other words, the heat storage section 180, heat storage water introduction pipe 181, heat storage section supply pipe 182, and heat storage water introduction pump 183 are configured so that warmed cooling water can be supplied to the cylinder head 111 and EGR cooler 150 at the time of a cold start.

When the cooling water is warmed to a predetermined high temperature (e.g., 80° C.) after termination of a warm-up period in a situation where the configuration described above is employed, the heat storage water introduction pump 183 is driven. High-temperature cooling water is then supplied to the heat storage section 180 via the heat storage section supply pipe 182. When the engine subsequently comes to a temporary halt, the heat storage section 180 stores the high-temperature cooling water while keeping it warm. When the engine starts cold, the heat storage water introduction pump 183 is driven.

In the above instance, the EGR cooler cooling switching valve 153 opens as indicated by an arrow in FIG. 5. This supplies thermally stored cooling water (heat storage water) to the cylinder head 111 and EGR cooler 150 at the time of a cold start, thereby warming the cylinder head 111 and EGR cooler 150. Thus, the configuration described above not only promotes an engine's warm-up operation but also avoids excessive EGR gas cooling. This enables a simple device configuration to effectively avoid emission degradation that may occur when a low-temperature EGR gas is introduced into the combustion chamber.

The heat storage water introduction pump 183 may be installed in the heat storage section supply pipe 182.

The heat storage water introduction pipe 181 may be directly connected to the EGR cooler 150.

The heat storage section 180 may include a heater or latent heat storage device that is configured to heat the cooling water at the time of a cold start.

(viii) It goes without saying that various other modified embodiments also fall within the scope of the present invention unless they depart from the spirit of the present invention. For example, in the foregoing embodiments, elements integrated into a single piece may be rendered integral with each other without joints or formed by gluing, depositing, screwing down, or otherwise joining a plurality of separate parts.

(ix) Functional elements constituting the "Means for Solving the Problem" include not only specific structures described in conjunction with the foregoing embodiments including the modified ones, but also any other structure that can implement the described functionality.

The invention claimed is:

1. An engine cooling medium circulation device configured to circulate a cooling medium for an engine, comprising:

a head internal cooling medium path formed inside a cylinder head;

a block internal cooling medium path formed inside a cylinder block;

a block cooling limitation section configured to be capable of limiting the passage of the cooling medium in the block internal cooling medium path in accordance with a temperature of the cooling medium;

an EGR cooler that is placed in an EGR path, the EGR path is configured to be capable of introducing a gas from an exhaust path of the engine to an intake path, the EGR cooler is configured to be capable of cooling the gas by exchanging heat between the gas and the cooling medium, an EGR cooling control section configured to be capable of controlling the supply of the cooling medium to the EGR cooler; and a high-temperature coolant supply section that is configured to be capable of supplying the cooling medium, which has been warmed, to the EGR cooler at the time of a cold start.

2. An engine cooling medium circulation device configured to circulate a cooling medium for an engine, comprising:

a head internal cooling medium path formed inside a cylinder head;

a block internal cooling medium path formed inside a cylinder block;

a block cooling limitation section configured to be capable of limiting the passage of the cooling medium in the block internal cooling medium path in accordance with a temperature of the cooling medium;

an EGR cooler that is placed in an EGR path, the EGR path is configured to be capable of introducing a gas from an exhaust path of the engine to an intake path, the EGR cooler is configured to be capable of cooling the gas by exchanging heat between the gas and the cooling medium, an EGR cooling control section configured to be capable of controlling the supply of the cooling medium to the EGR cooler, a cooling medium delivery section configured to be capable of delivering the cooling medium to the head internal cooling medium path;

a cooling medium delivery pipe arranged to connect the cooling medium delivery section to the head internal cooling medium path;

an EGR cooling branch pipe that branches off from the cooling medium delivery pipe and is connected to the EGR cooler; and an EGR cooling medium discharge pipe that is connected to the EGR cooler to form a path for discharging the cooling medium from the EGR cooler, a radiator that is positioned upstream of the cooling medium delivery section in a flow direction of the cooling medium, wherein the EGR cooling control section includes an EGR cooling adjustment valve that is installed in the EGR cooling branch pipe or the EGR cooling medium discharge pipe, and the cooling medium passed through the radiator and delivered by the cooling medium delivery section may flow into the EGR cooling branch pipe.

3. The engine cooling medium circulation device according to claim 2, further comprising:

a cylinder head discharge pipe that is connected to the head internal cooling medium path to form a path for the cooling medium to flow from the cylinder head to the radiator;

a cylinder block discharge pipe that is connected to the block internal cooling medium path to form a path for the cooling medium to flow from the cylinder block to the radiator; and an inter-block flow path that connects the head internal cooling medium path to the block internal cooling medium path, wherein the EGR cooling adjustment valve includes a first adjustment valve that is configured to be capable of changing a flow state of the cooling medium between the cylinder head discharge pipe, the cylinder block discharge pipe, and the radiator in accordance with the temperature of the cooling medium.

4. The engine cooling medium circulation device according to claim 3, further comprising:

a radiator discharge pipe that connects the radiator to the cooling medium delivery section;

a bypass pipe that connects the cylinder head discharge pipe to the radiator discharge pipe; and a second adjustment valve that is configured to be capable of changing the flow state of the cooling medium in the bypass pipe in accordance with the temperature of the cooling medium.

5. The engine cooling medium circulation device according to claim 4, wherein the EGR cooling control section is configured to place a limit on the supply of the cooling medium to the EGR cooler during a warm-up period of the engine and lift the limit on the supply of the cooling medium to the EGR cooler at around the end of the warm-up period.

6. The engine cooling medium circulation device according to claim 4, further comprising a high-temperature coolant supply section that is configured to be capable of supplying the cooling medium, which has been warmed, to the EGR cooler at the time of a cold start.

* * * * *